United States Patent [19]

Asai

[11] Patent Number: 4,875,658

[45] Date of Patent: Oct. 24, 1989

[54] ELECTROMAGNETIC VALVE

[75] Inventor: Yoshiro Asai, Kyoto, Japan

[73] Assignee: Mitsubishi Jidosha Kogyo Kabushiki Kaisha, Tokyo, Japan

[21] Appl. No.: 106,612

[22] Filed: Oct. 6, 1987

[30] Foreign Application Priority Data

Oct. 8, 1986 [JP] Japan ..... 61-0238086
Oct. 8, 1986 [JP] Japan ..... 61-0238087

[51] Int. Cl.[4] ..... F16K 31/06

[52] U.S. Cl. ..... 129.21; 251/129.15; 251/368; 239/585

[58] Field of Search ..... 251/368, 129.21, 129.15; 239/585

[56] References Cited

U.S. PATENT DOCUMENTS

| | | | |
|---|---|---|---|
| 4,025,887 | 5/1977 | Romans . | |
| 4,334,552 | 6/1982 | Blanchard | 251/368 |
| 4,676,478 | 6/1987 | Kiuchi | 251/129.21 |

FOREIGN PATENT DOCUMENTS

| | | |
|---|---|---|
| 0025382A | 3/1981 | European Pat. Off. . |
| 2059169 | 6/1972 | Fed. Rep. of Germany . |
| 2628190A1 | 12/1976 | Fed. Rep. of Germany . |
| 3016993 | 11/1980 | Fed. Rep. of Germany . |
| 2932433 | 2/1981 | Fed. Rep. of Germany . |
| 3149916A1 | 7/1982 | Fed. Rep. of Germany . |
| 3314900A1 | 10/1984 | Fed. Rep. of Germany . |
| 3506842A1 | 9/1985 | Fed. Rep. of Germany . |
| 3437162A1 | 4/1986 | Fed. Rep. of Germany . |
| 3601663A1 | 7/1986 | Fed. Rep. of Germany . |
| 3609901A1 | 9/1987 | Fed. Rep. of Germany . |
| 2050698A | 1/1981 | United Kingdom . |
| 2140627A | 11/1984 | United Kingdom . |
| 2155693A | 9/1985 | United Kingdom . |

*Primary Examiner*—Arnold Rosenthal
*Attorney, Agent, or Firm*—Frishauf, Holtz, Goodman & Woodward

[57] ABSTRACT

An is an electromagnetic valve disposed in a fluid passage to open or close the passage. A solenoid and a guide member having a guide hole are disposed in the housing. A plunger is disposed between the solenoid and the guide member and responds to energization of the solenoid. A valve member, which is coupled to the plunger to open or close the fluid passage in accordance with an energization state of the solenoid, is slidably fitted in the guide hole of the guide member. The plunger is made of a magnetic material, while of the guide member and the valve member, at least the valve member is made of a non-magnetic material and has an outer surface thereof subjected to a nitriding process. This prevents adhesion of iron powder to the valve member, eliminates an adverse influence of the magnetic field of the solenoid, and further improves the corrosion resistance and wear resistance thus ensuring smooth actuation of the valve member.

13 Claims, 3 Drawing Sheets

ELECTROMAGNETIC VALVE

BACKGROUND OF THE INVENTION

The present invention relates to an electromagnetic valve which is operated by an energization control of a solenoid and has a valve member for opening and closing a fluid passage, and more particularly, to an electromagnetic valve suitable for an injector of an electronic-controlled fuel injecting apparatus that is used in an engine using gasoline, LPG, alcohol, etc. as fuel, a control valve for use in a hydraulic apparatus such as an automatic speed control apparatus, or the like.

To begin with, one application of a conventional electromagnetic valve will now be explained.

Recently, in vehicles powered by a gasoline engine, electronic-controlled fuel injecting apparatuses are being used as a fuel feeding apparatus in order to improve fuel consumption, the output characteristic of the engine and purifying of exhausted gases. The electronic-controlled fuel injecting apparatuses use fuel injecting valves (hereinafter simply called "injectors") or an electromagnetic valve to inject fuel, which is normally kept at a constant pressure, into an intake passage located, for example, upstream or downstream of a throttle valve or located at an intake port, or into a fuel combustion chamber, and employ, as an injection rate control system, an intermittent injection system which opens the injector for a certain period of time in accordance with the amount of air supplied per engine cycle. That is, the amount of injecting fuel depends only on the width of an electric pulse applied to the injector, thus ensuring easy and highly accurate fuel control. Further, since operation control parameters for the engine are all converted into electric signals based on which the pulse applying duration is determined, the system for calculating the pulse applying duration has a greater freedom for its modification and correction parameters can easily be added.

The injector comprises a housing, a valve body mounted on the distal end of the housing, a solenoid fixedly supported in the housing, and a valve needle slidably fitted in a guide hole formed in the valve body and coupled to a plunger which is made of a magnetic material and is driven by the electromagnetic force of the solenoid in cooperation with a spring. When the electric pulse is applied to the solenoid, the plunger is attracted against the force of the spring. With the movement of the plunger, the valve needle is pulled to inject fuel through an injection opening of the valve body. The fuel injection rate is determined by the circular gap between the distal end of the valve needle and the injection opening of the valve body and the fuel pressure.

To improve the durability of such an injector, the valve body and valve needle are usually made of stainless steel such as SUS440C having wear resistance and are subjected to heat treatment to increase their hardness.

Another use of a conventional electromagnetic valve will now be explained.

A hydraulic apparatus such as an auto-transmission control system uses many hydraulic control valves, which are usually solenoid valves that are easy to control. This type of control valve typically comprises a solenoid accommodated, in a housing, a valve guide also accommodated in the housing, and a valve rod slidably fitted in a guide hole formed in the valve guide. The valve rod is coupled to a plunger that is driven by the electromagnetic force of the solenoid in cooperation with a spring. When the solenoid is deenergized, the force of the spring pushes the valve rod to close the control valve. When the solenoid is energized, the electromagnetic force of the solenoid attracts the plunger against the force of the spring so as to pull the valve rod to open the control valve.

To improve the durability of the control valve, the valve rod is usually formed of stainless steel such as SUS304 or SUS440C, which is corrosion-resisting and wear-resisting, and is further subjected to a surface nitriding process if it is SUS304, or subjected to heat treatment for surface hardening to increase the hardness of the valve rod if it is SUS440C.

As the stainless steel such as SUS304 is a ferromagnetic material, however, it would be magnetized through the manufacturing processes and iron powder would adhere to the steel. The adhesion of iron powder adversely influences the process accuracy, fluid-tight testing, flow rate setting, or the like. The stainless steel, when subjected to heat treatment, has a martensite structure and is magnetized. Further, when driven, the valve needle or valve rod (these are called "valve members") is influenced by the magnetic field of the solenoid and is magnetized. As, a result, magnetic powder produced by wearing of the sliding section between the valve needle and valve body or the valve rod and valve guide, which is caused by operation of the valve needle or valve rod, iron powder adhering to and remaining in a fuel system during the manufacturing process, or iron powder mixed in oil adheres to the sliding section, or the iron powder adhere to the sliding section falls there off and adheres the injection hole or the valve seat. Consequently, the actuation of the valve members would be interfered, thus deteriorating the fuel injection characteristic or hydraulic control characteristic, or the wearing of the sliding surface would be hastened due to the magnetic powder and iron powder coming into the sliding section. When the valve members are magnetized, attraction or repulsion is caused between the valve needle and valve body or the valve rod and valve guide, thereby interfering smooth actuation of the valve members or impairing the control characteristic.

SUMMARY OF THE INVENTION

It is a primary object of this invention to provide an electromagnetic valve which ensures smooth actuation of valve members and has high corrosion resistance and wear resistance.

It is another object of this invention to provide an electromagnetic valve which prevents adhesion of iron powder to valve members, eliminates adverse influence of a magnetic field generated by a solenoid and has further improved corrosion resistance and wear resistance.

It is yet another object of this invention to provide an electromagnetic valve which is suitable for a fuel injection valve for injecting fuel into an engine, ensures smooth actuation of valve members and has high corrosion resistance and wear resistance.

It is still another object of this invention to provide an electromagnetic valve which is suitable for a control valve disposed in a hydraulic circuit to control the opening/closing of an oil passage, ensures smooth actuation of valve members and has high corrosion resistance and wear resistance.

This invention provides an electromagnetic valve which is disposed in a fluid passage and open or close the passage. This electromagnetic valve has a housing in which a solenoid and a guide member having a guide hole are disposed. A plunger which responds to the energization of the solenoid is disposed between the solenoid and the guide member. A valve member, which is coupled to the plunger and responds to the energization of the solenoid to open or close the fluid passage, is slidably fitted in the guide hole of the guide member. The plunger is made of a magnetic material while of the guide member and valve member, at least the valve member is made of a non-magnetic material and its outer surface is subjected to a nitriding process.

Since at least the valve member is made of a non-magnetic material, it is not magnetized by the magnetic field produced by the solenoid so that no residual magnetization is present on the valve member. This prevents adhesion of iron powder produced with the actuation of the valve member or mixed in oil to the valve member, and prevents attraction or repulsion between the valve member and the guide member from being caused by the magnetic field of the solenoid. Accordingly, the actuation of the valve member is smoothened.

In addition, since the outer surface is nitrided, the wearing of the valve member is suppressed so as to prevent generation of iron powder.

Further, a solenoid-originated magnetic circuit is not disturbed by the valve member made of a non-magnetic material, and is rather concentrated in the direction to attract the plunger so that the attraction force of the solenoid is increased and the response of the valve member is improved.

Preferably, the guide member and valve member are both made of a non-magnetic material and the outer surface of the valve member is subjected to a nitriding process and a carburizing process.

The electromagnetic valve of this invention is suitable for a fuel injection valve that opens or closes a fuel supplying passage to inject fuel into an intake passage to an internal combustion engine.

The electromagnetic valve of this invention is also suitable for a control valve that opens or closes an oil passage of a hydraulic apparatus to control the flow of working oil.

The above objects as well as other objects, features and advantages of the present invention will become apparent to those of ordinary skill in the art as the following detailed description proceeds with reference to the accompanying drawings.

DETAILED DESCRIPTION OF THE PREFERRED EMBODIMENTS

Figure 1:
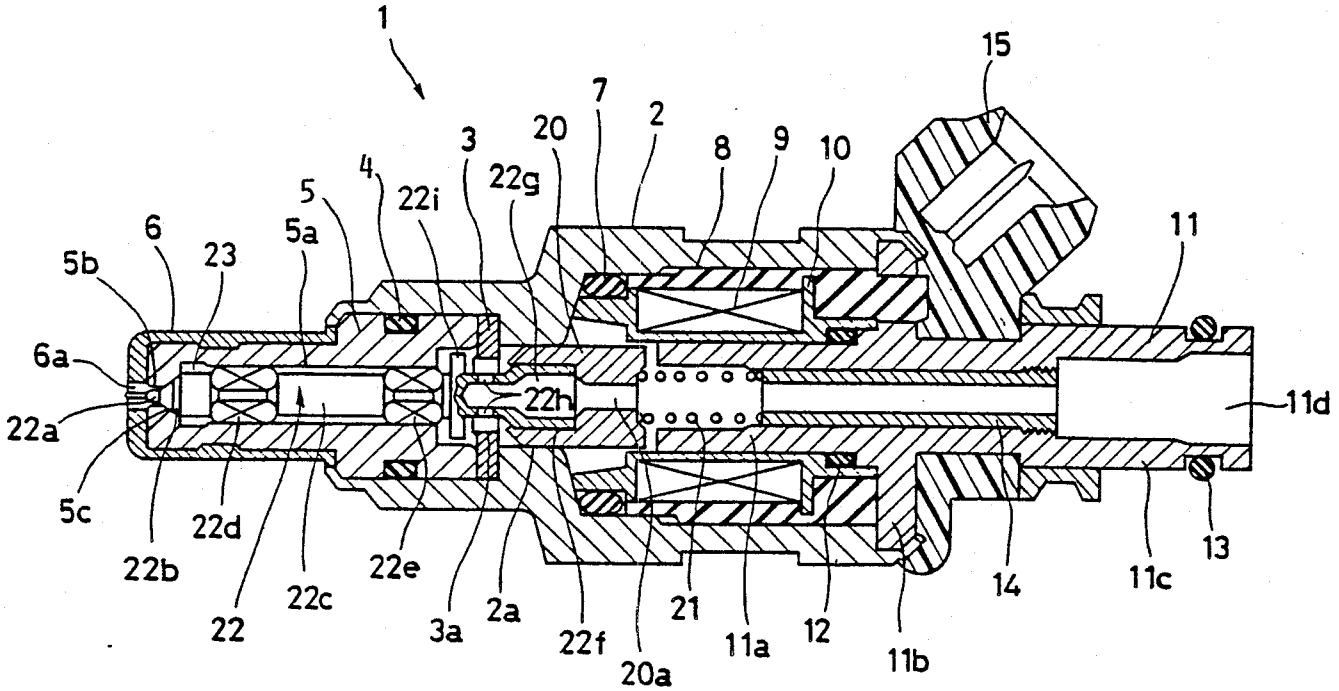
FIG. 1 is a cross-sectional view of an electromagnetic valve according to one embodiment of this invention which is used as a fuel injection valve for use in an internal combustion engine.

FIG. 1 illustrates a cross section of an injector as the first embodiment of an electromagnetic valve to which the present invention is directed. A valve body 5 serving as a guide member is fixed through a stopper 3 to the distal end of a housing 2 that constitutes the outer shell of an injector 1. The valve body 5 is mounted in fluid-tight to the housing 2 through a seal member 4. Further, a cap 6 is fixed to the distal end of the valve body 5. A bobbin 10 having a solenoid 9 wound thereon is fitted in the housing 2 through seal members 7 and 8. At the rear end of the housing 2 is mounted a holder 11 that is made of a magnetic material. The holder 11 has its one end **11*a* fitted in the housing 2 and also in a central through hole of the bobbin 10 through a seal member 12. The holder 11 has its central portion 11*b* firmly caulked at an opening edge of the housing 2, and has the other end 11*c* protruding outward from the housing 2 and coupled to a fuel hose (not shown) through a seal member 13**.

A fuel passage **11*d* is formed through the holder 11 along the axis thereof, and a cylindrical stopper 14 is fixedly fitted approximately the center of the passage 11*d*. Further, at the center portion of the holder 11 is fixedly mounted a connector 15 to which a connection terminal of the solenoid 9 is coupled. This connector 15** is coupled to a driver of an electronic-controlled fuel injecting apparatus (not shown).

A plunger 20 which has a fuel passage **20*a* formed along its axis and is made of a magnetic material, is slidably fitted in the housing 2 between the stopper 3 and the bobbin 10. The plunger 20 has its one end fitted in a hole 2*a* of the housing 2 and has the other end provided to be insertable in an opening of the central through hole of the bobbin 10. A spring 21 is provided in a pressed manner between the other end of the plunger 20 and that end surface of the stopper 14 in the holder 11** which faces the plunger's other end.

A valve needle 22 is slidably fitted in a guide hole **5*a* formed along the axis of the valve body 5, and has a distal end 22*a*, which loosely penetrates an injection hole 5*b* formed in the distal end of the valve body 5 with a slight gap and also loosely penetrates an injection hole 6*a* of the cap 6. An end surface 22*b* of the valve needle 22 abuts against a valve seat 5*c* of the valve body 5. A shaft portion 22*c* of the valve needle 22 has a slightly smaller diameter than the hole 5*a* of the valve body 5. Larger diameter portions 22*d* and 22*e* formed at both ends of the shaft portion 22*c* are slidably fitted in the hole 5*a* of the valve body 5 and each have the circumferential surface cut to have four equal flat surfaces in the circumferential direction. A fuel passage is formed between each cut face of the larger diameter portions 22*d* and 22*e* and the inner wall of the hole 5*a* of the valve body 5**.

TABLE 1

| Name of Steel | Chemical Compositions (%) | | | | | | | | |
|---|---|---|---|---|---|---|---|---|---|
| | C | Si | Mn | P | S | Cu | Ni | Cr | N |
| PCD65 | 0.60~ 0.70 | 0.60~ 0.90 | 13.25~ 14.75 | ≦ 0.050 | ≦ 0.030 | ≦ 0.30 | ≦ 0.30 | 2.00~ 2.50 | Added |
| | 0.20~ | 1.70~ | 22.50~ | ≦ | ≦ | ≦ | 2.80~ | 5.40~ | |

TABLE 1-continued

| Name of Steel | Chemical Compositions (%) | | | | | | | | |
|---|---|---|---|---|---|---|---|---|---|
| | C | Si | Mn | P | S | Cu | Ni | Cr | N |
| PCD23 | 0.26 | 2.20 | 24.50 | 0.030 | 0.010 | 0.30 | 3.30 | 6.00 | — |
| | 0.05~ | 0.20~ | 17.50~ | ≦ | ≦ | ≦ | 2.00~ | 14.00~ | |
| PCD18 | 0.25 | 0.70 | 18.50 | 0.040 | 0.015 | 0.30 | 3.00 | 17.00 | Added |
| | 0.35~ | 0.50~ | 7.80~ | ≦ | 0.17~ | 1.80~ | 5.50~ | 4.70~ | |
| UPCD40V | 0.45 | 0.90 | 9.30 | 0.040 | 0.23 | 2.30 | 6.30 | 5.50 | — |

Remark: These steels are of manufacturer's standard.

A rear end 22*f* of the valve needle 22 loosely penetrates a hole 3*a* of the stopper 3 and protrudes toward the plunger 20 to be fixedly mounted to that end of the plunger 20 which faces the end 22*f*. A hole 22*g* is drilled in the shaft center of the rear end 22*f* of the valve needle 22, and the opening end of the hole 22*g* communicates with the fuel passage 20*a* of the plunger 20 and communicates with the outside through a plurality of holes 22*h* formed in the side wall of the rear end 22*f* at the proximity of the bottom of the hole 22*g*.

The valve body 5 and valve needle 22 are formed of a non-magnetic steel material which is corrosion-resisting and wear-resisting. As such a non-magnetic steel material, those having chemical compositions as shown in Table 1, for example, are used.

To improve the wear resistance without magnetizing the non-magnetic steel materials, they are subjected to a surface treatment to harden their surfaces. There are various types of surface treatments which include ion carbon-nitriding, ion nitriding, gas nitriding, plasma carbon-nitriding, plasma nitriding and tufftriding.

Figure 3:
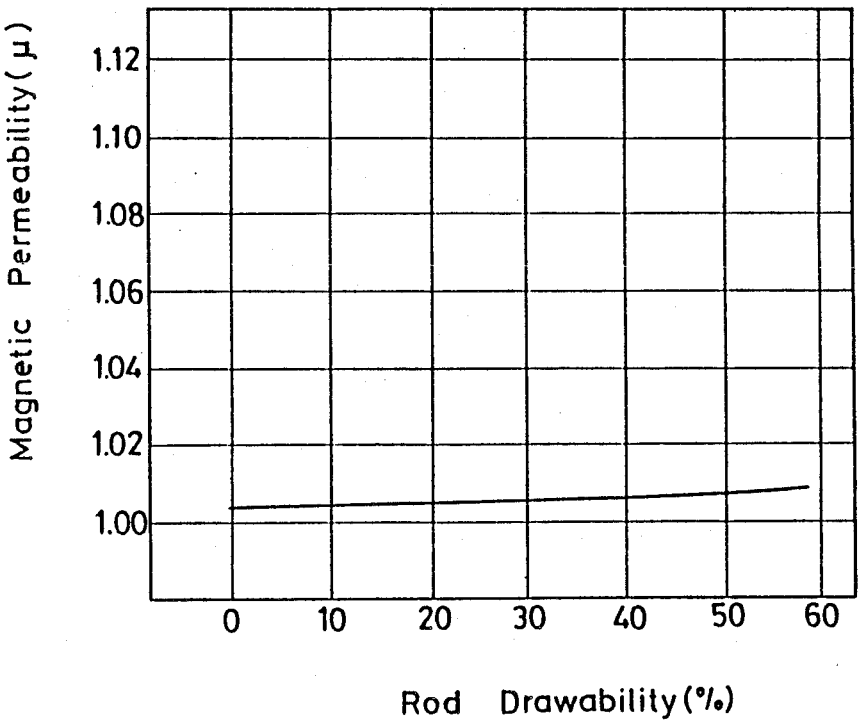
FIG. 3 is a graph illustrating the relationship between rod drawability and magnetic permeability as a magnetic characteristic of a non-magnetic steel member that is used for a valve member of the electromagnetic valves as shown in FIGS. 1 and 2.

In this embodiment, PCD18 shown in Table 1 is used as a steel material for the valve body 5 and the valve needle 22, and ion carbon-nitriding process is executed as the surface treatment. This steel material PCD18 has a magnetic characteristic as indicated by the solid line in FIG. 3. As should be obvious from the relationship between the rod drawability and the magnetic permeability, the valve body 5 and the valve needle 22 made of the steel material PCD18, would not substantially be magnetized through their manufacturing processes.

Since this non-magnetic steel material PCD18 contains manganese (Mn) and chromium (Cr), it is hard and has an excellent wear resistance. When the steel material PCD18 is wire-drawn for its work hardening, its mechanical strength is further improved. Moreover, when the surface of the steel member is subjected to a ion carbon-nitriding process, a good carbon-nitride layer can be obtained because of its contents N and C, thus further improving the wear resistance while providing a stable non-magnetization. Furthermore, due to a large amount of Cr and Ni contained, the steel member has a significantly high corrosion resistance property. In addition, because of the chemical compositions as shown in Table 1, the material cost is not so high.

The other structural elements, such as housing 2, holder 11 and plunger 20, are made of the same material as those of a conventional injector.

The operation of the injector will now be explained.

When the solenoid 9 is deenergized, the spring 21 pushes the plunger 20 from the bobbin 10 as illustrated in FIG. 1. This pushes the valve needle 22 so that the end surface 22*b* is pressed against the valve seat 5*c* of the valve body 5, thereby closing the injection hole 5*b*. This puts the injector 1 in a valve-closed state. Pressurized fuel is supplied in the fuel passage 11*d* of the holder 11 through the hose (not illustrated) and is further supplied with a predetermined fuel pressure to the oil chamber 23, located at the distal end of the valve body 5, through the individual passages 20*a*, 22*g* and 22*h* of the plunger 20 and valve needle 22, the hole 3*a* of the stopper 3, and the gaps between the hole 5*a* of the valve holder 5, and each cut flat surface of the larger diameter portion 22*e*, the shaft portion 22*c* and each cut surface of another larger diameter portion 22*d* of the valve needle 22.

When the solenoid 9 is energized by the driver of the electronic-controlled fuel injecting apparatus, the plunger 20 is being attracted against the force of the spring 21 by the electromagnetic force of the solenoid 9 during its energization, so that the other end of the plunger 20 is pulled inside the bobbin 10. With this movement, the valve needle 22 moves rightwards in FIG. 1 until its land 22*i* abuts on the stopper 3 and stops there, so that the end surface 22*b* is separated from the valve seat 5*c* of the valve body 5 to thereby open the injection hole 5*b*. As a result, the fuel inside the oil chamber 23 is injected by the fuel pressure into an intake passage (not shown) from the injection hole 5*b*.

Since the valve body 5 and valve needle 22 are made of a non-magnetic material when a magnetic field is generated by the energized solenoid 9, they are not magnetized by the magnetic field and do not have any residual magnetization thereon. Therefore, as mentioned earlier, no attraction or repulsion would occur between the valve body 5 and valve needle 22 so that both can be smoothly actuated. In addition, the magnetic circuit generated by the solenoid 9 is not interfered by the valve body 5 or the like which is of a non-magnetic material and maintains a good magnetic circuit, thus improving the response characteristic of the valve needle 22. Furthermore, since the valve body 5 and valve needle 22 are made of a steel material having excellent corrosion resistance and wear resistance and are subjected to the carbon-nitriding process, their abrasion is insignificantly small and generation of iron powder by the actuation of the valve needle 22 can by significantly suppressed. This smoothens the actuation of the injector 1 and the fuel injection.

This embodiment has been described with the case where both the valve body and valve needle are made of the non-magnetic material, but is not limited to this particular case. The valve needle alone may be made of the aforementioned non-magnetic material. Further, according to the first embodiment, the valve needle which has its distal end shaped to protrude from the injection hole 6*a* is used as the valve member of the injector 1. However, the same effects can be attained even when the valve member has a spherical distal end or has a circular plate shape.

Figure 2:
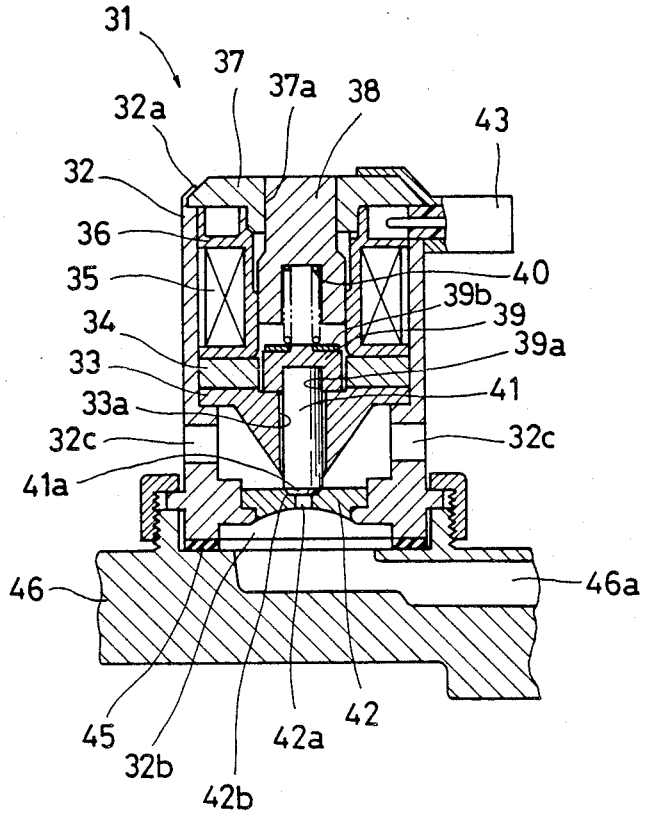
FIG. 2 is a cross-sectional view of an electromagnetic valve according to another embodiment of this invention which is used as a control valve that is disposed in a hydraulic control circuit to control the flow of working oil.

Referring now to FIG. 2, the second embodiment of this invention will be described in detail.

FIG. 2 illustrates a cross section of a control valve to which this invention is applied. This control valve 31 is assembled in a hydraulic apparatus 46 to control the flow of working oil. A valve guide 33 serving as a guide member, and a bobbin 36 having a solenoid 35 wound therearound through a plate 34 constituting a magnetic circuit are disposed in fluid-tight in a housing 32 that constitutes the outer shell of the control valve 31. Further, a cover 37 is mounted on an opening end 32a and is firmly caulked to the periphery of the opening end 32a in fluid-tight fashion. A yoke 38 has its one end fixedly fitted in a hole 37a formed in the center of the cover 37, and has the other end fitted in a central through hole of bobbin 36. This yoke 38 is magnetically coupled to the housing 32 through the cover 37.

A plunger 39 which is made of a magnetic material, is disposed in the housing 32 between the valve guide 33 and the yoke 38 to be insertable in the bobbin 36. A spring 40 is provided in a pressed manner between the yoke 38 and a spacer 39b provided on the upper surface of the plunger 39. A valve rod 41 as a valve member is slidably fitted in a guide hole 33a of the valve guide 33, and has its one end fixedly fitted in a hole 39a formed in the plunger 39. An end surface 41a of the other end of the valve rod 41 is abuttable, by the force of the spring 40, on a valve seat 42b of a hole 42a, which is formed in association with the end surface 41a in an end plate 42 that is attached in fluid-tight to the other opening end 32b of the housing 32. Holes 32c, 32c which communicate with an oil passage, are formed in that side wall of the housing 32 which is located on the side of the opening end 32b.

A connector 43 is fixed to the side wall of the opening end 32a of the housing 32 and is coupled to a connection terminal of the solenoid 35. This connector 43 is coupled to a driver of a hydraulic control apparatus (not shown).

The valve rod 41 is formed of a non-magnetic steel material which is corrosion-resisting and wear-resisting. As such a non-magnetic steel material, those shown in Table 1 are used.

To improve the wear-resistance without magnetizing the non-magnetic steel materials, they are subjected to a surface treatment to harden their surfaces. There are various types of surface treatments which include ion carbon-nitriding, ion nitriding, gas nitriding, plasma carbon-nitriding, plasma nitriding and tufftriding.

In this embodiment, PCD18 shown in Table 1 is used as a steel material for the valve rod 41 as per the first embodiment, and an ion nitriding process is executed as the surface treatment.

Thus constituted solenoid valve 31 is mounted to the hydraulic apparatus 46 through a seal member 45 and the opening end 32b of the housing 32 communicates with an oil passage 46a of the hydraulic apparatus 46. The individual holes 32c, 32c of the housing 32 are coupled to an unillustrated oil passage of the hydraulic apparatus 46 to constitute a hydraulic control system.

The operation of the control valve 31 will now be explained.

When the solenoid 35 is deenergized, the spring 40 pushes the plunger 39 from the bobbin 36 as illustrated in FIG. 2. This pushes the valve rod 41 so that the end surface 41a is pressed against the valve seat 42b, thereby closing the hole 42a. This puts the control valve 31 in a closed state. The valve opening pressure for the control valve 31 is set by the spring pressure of the spring 40.

When the solenoid 35 is energized by the driver of the hydraulic control apparatus, the plunger 39 is being attracted against the force of the spring 40 by the electromagnetic force of the solenoid 35 and is pulled inside the bobbin 36. Thereafter, the end surface of the plunger 39 abuts on that end surface of the yoke 38 which face the plunger's end surface and stops there. With the movement of the plunger 39, the valve rod 41 separates its end surface 41a from the valve seat 42b so as to open the control valve. As a result, the oil passage 46a of the hydraulic apparatus 46 communicates with the individual oil passages coupled to the holes 32c, 32c of the housing 32, permitting the working oil to flow from the oil passage 46a to the individual oil passages through the control valve 31. When the solenoid is deenergized, as mentioned above, the plunger 39 is pressed by the force of the spring 40 to close the control valve 31.

Since the valve rod 41 is made of a non-magnetic material, as mentioned above, the valve rod 41 is not magnetized by a magnetic field generated by energization of the solenoid 35 and does not have any residual magnetization thereon. Further, since the valve rod 41 is made of a steel material which is excellent in corrosion resistance and wear resistance, its abrasion is insignificantly small and generation of iron powder caused by the abrasion of the valve rod at the time it is actuated can be significantly suppressed. This prevents the iron powder generated by the actuation of the valve rod 41 or mixed in the working oil from being attracted by and adhered to the sliding section or the end surface 41a of the valve rod 41. Consequently, the tightness between the valve rod 41 and the valve seat 42b can be secured and a smooth actuation of the valve rod 41 can be maintained. This improves the control characteristic of the hydraulic control apparatus.

In the second embodiment, only the valve rod 41 is made of a non-magnetic material. If the valve guide 33 in which the valve rod 41 is fitted is also made of a non-magnetic material, iron powder does not adhere to the sliding surface of the valve guide 33 and the valve rod 41 can be more smoothly and assuredly actuated.

The aforementioned control valve may be assembled in a hydraulic apparatus of an automobile, such as a auto-transmission control system, an anti-skid braking system, a power steering system or a suspension control system, or various types of hydraulic control apparatuses for industrial machines.

What is claimed is:

1. An electromagnetic valve which is disposed in a fluid passage to open or close said passage, said valve comprising:

a housing;

a solenoid disposed in said housing;

a guide member disposed in said housing and having a guide hole;

a plunger disposed between said solenoid and said guide member and responsive to energization of said solenoid; and a valve member, slidably fitted in said guide hole of said guide member and coupled to said plunger, for opening and closing said fluid passage in accordance with an energization state of said solenoid;

said plunger being made of a magnetic material, and of said guide member and said valve member, at least said valve member being made of a non-magnetic high-magnesium austenitic steel containing 7.8% to 24.5% manganese and having an outer surface thereof subjected to a plasma nitriding process.

2. The electromagnetic valve according to claim 1, wherein both of said guide member and said valve member are made of said non-magnetic high-magnesium austenitic steel containing 7.8% to 24.5% manganese.

3. The electromagnetic valve according to claim 1, wherein said outer surface of said valve member is subjected to a plasma carbon-nitriding process.

4. The electromagnetic valve according to claim 1, wherein said fluid passage is a fuel supplying passage for feeding fuel to an internal combustion engine, and said electromagnetic valve is a fuel injection valve for injecting fuel in an intake passage of said internal combustion engine.

5. An electromagnetic valve according to claim 1, wherein said fluid passage is an oil passage of a hydraulic apparatus and said electromagnetic valve is a control valve for opening or closing said oil passage to control a flow of working oil.

6. An electromagnetic valve according to claim 2, wherein said fluid passage is a fuel supplying passage for feeding fuel to an internal combustion engine, and said electromagnetic valve is a fuel injection valve for injecting fuel in an intake passage of said internal combustion engine.

7. An electromagnetic valve according to claim 2, wherein said fluid passage is an oil passage of a hydraulic apparatus and said electromagnetic valve is a control valve for opening or closing said oil passage to control a flow of working oil.

8. An electromagnetic valve according to claim 3, wherein said fluid passage is a fuel supplying passage for feeding fuel to an internal combustion engine, and said electromagnetic valve is a fuel injection valve for injecting fuel in an intake passage of said internal combustion engine.

9. An electromagnetic valve according to claim 3, wherein said fluid passage is an oil passage of a hydraulic apparatus and said electromagnetic valve is a control valve for opening or closing said oil passage to control a flow of working oil.

10. The electromagnetic valve according to claim 2 wherein said high magnesium austenitic steel contains 13.25 to 14.75% manganese.

11. The electromagnetic valve according to claim 2 wherein said high magnesium austenitic steel contains 22.5 to 24.5% manganese.

12. The electromagnetic valve according to claim 2 wherein said high magnesium austenitic steel contains 17.5 to 18.5% manganese.

13. The electromagnetic valve according to claim 2 wherein said high magnesium austenitic steel contains 7.8 to 9.3% manganese.

* * * * *